US011933139B1

(12) United States Patent
Al-Mousa et al.

(10) Patent No.: US 11,933,139 B1
(45) Date of Patent: Mar. 19, 2024

(54) SHIFTING TOOL FOR SPOTTING FILTER CAKE REMOVER

(71) Applicant: SAUDI ARABIAN OIL COMPANY, Dhahran (SA)

(72) Inventors: Ahmed Abdullah Al-Mousa, Doha (SA); Marius Neascu, Dhahran (SA); Omar M. Alhamid, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/060,701

(22) Filed: Dec. 1, 2022

(51) Int. Cl.

| | |
|---|---|
| ***E21B 37/00*** | (2006.01) |
| ***E21B 33/12*** | (2006.01) |
| ***E21B 34/06*** | (2006.01) |
| ***E21B 34/14*** | (2006.01) |
| ***E21B 43/08*** | (2006.01) |

(52) U.S. Cl.
CPC ..... *E21B 37/00* (2013.01); *E21B 34/063* (2013.01); *E21B 34/14* (2013.01); *E21B 33/12* (2013.01); *E21B 43/08* (2013.01)

(58) Field of Classification Search
CPC ..... E21B 37/00; E21B 34/063; E21B 34/14; E21B 33/12; E21B 43/08
See application file for complete search history.

(56) References Cited

U.S. PATENT DOCUMENTS

| | | | | |
|---|---|---|---|---|
| 6,725,929 | B2 * | 4/2004 | Bissonnette | E21B 34/14 166/278 |
| 8,757,273 | B2 | 6/2014 | Themig et al. | |
| 8,991,505 | B2 | 3/2015 | Fleckenstein et al. | |
| 2018/0258738 | A1 * | 9/2018 | Lan | E21B 33/12 |

FOREIGN PATENT DOCUMENTS

| | | |
|---|---|---|
| EP | 3135858 B1 | 2/2018 |

* cited by examiner

*Primary Examiner* — Dany E Akakpo
(74) *Attorney, Agent, or Firm* — Vorys, Sater, Seymour and Pease, LLP

(57) ABSTRACT

A method for removing filter cake from a subterranean wellbore includes running a completion string into the wellbore on production tubing, the completion string including one or more screen assemblies coupled therein, conveying a running tool through the production tubing to a shifting tool arranged within the completion string, opening a circulation port of the shifting tool with the running tool, flowing a spotting fluid through the running tool and the shifting tool and discharging the spotting fluid from the completion string into an annulus defined between the completion string and the wellbore, interacting the spotting fluid with the filter cake to remove the filter cake from a wall of the wellbore, and circulating the spotting fluid from the annulus and into the production tubing through the circulation port.

15 Claims, 7 Drawing Sheets

SHIFTING TOOL FOR SPOTTING FILTER CAKE REMOVER

FIELD OF THE DISCLOSURE

The present disclosure relates generally to systems and methods for removing filter cake from a subterranean wellbore and, more particularly, to the removal of filter cake from specified intervals subsequent to installing a lower completion assembly in the wellbore.

BACKGROUND OF THE DISCLOSURE

A drill bit at a lower end of a drill string is often advanced through a geologic formation to form a subterranean wellbore. A drilling fluid or "mud" is circulated down the drill string, out through nozzles in the drill bit and returned to the surface through an annulus defined between the drill string and a wall of the wellbore. The circulation of drilling fluid cools the drill bit and carries geologic cuttings from the wellbore. During drilling operations, some of the drilling fluid may be lost into the surrounding geologic formation. To prevent these losses, a drilling fluid may be modified such that a small portion of the fluid, and any solids carried by the drilling fluid, form a coating on the wellbore wall, i.e., a filter cake.

Once the drilling operations are complete, the filter cake is removed to permit hydrocarbons or other targeted fluids to flow into the wellbore from the geologic formation. The wall of the wellbore may be washed with suitable fluids to dissolve or dislodge the filter cake, and subsequently, a lower completion including valve screens may be installed to receive the targeted fluids and facilitate production to the surface. Failures may occur in the installation of the lower completion that result in the lower completion becoming lodged in the wellbore. The accumulation of filter cake on the wellbore walls may make retrieval of the lower completion difficult in these failed installations. Even in successful installations, filter cake remaining on the wellbore wall may hinder the production of the targeted fluids through the lower completion.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method for removing filter cake from a subterranean wellbore includes (a) running a completion string into the wellbore on a string of production tubing, wherein the completion string includes one or more screen assemblies coupled therein, (b) conveying a running tool through the production tubing until the running tool reaches a shifting tool coupled within the completion string, (c) opening a circulation port of the shifting tool with the running tool, (d) flowing a spotting fluid through the running tool to and the shifting tool, (e) discharging the spotting fluid from the completion string into the wellbore, (f) interacting the spotting fluid with the filter cake to remove the filter cake from a wall of the wellbore and (g) circulating the spotting fluid through the circulation port.

In another embodiment, a system for removing filter cake from a subterranean wellbore includes a string of production tubing extending into the wellbore, a completion string defined at a lower end of the production tubing, a shifting tool coupled within the completion string and a running tool at a lower end of a conveyance extending through the string of production tubing. The completion string includes one or more screen assemblies coupled therein. The shifting tool includes a circulation port extending between a central flow channel and an exterior of the shifting tool and a sleeve assembly selectively movable within the central flow channel between a first longitudinal position wherein the circulation port is obstructed and a second longitudinal position wherein the circulation port is closed. The running tool is selectively operable to move the sleeve assembly between the first and second longitudinal positions and to deliver a spotting fluid from the conveyance through the shifting tool.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
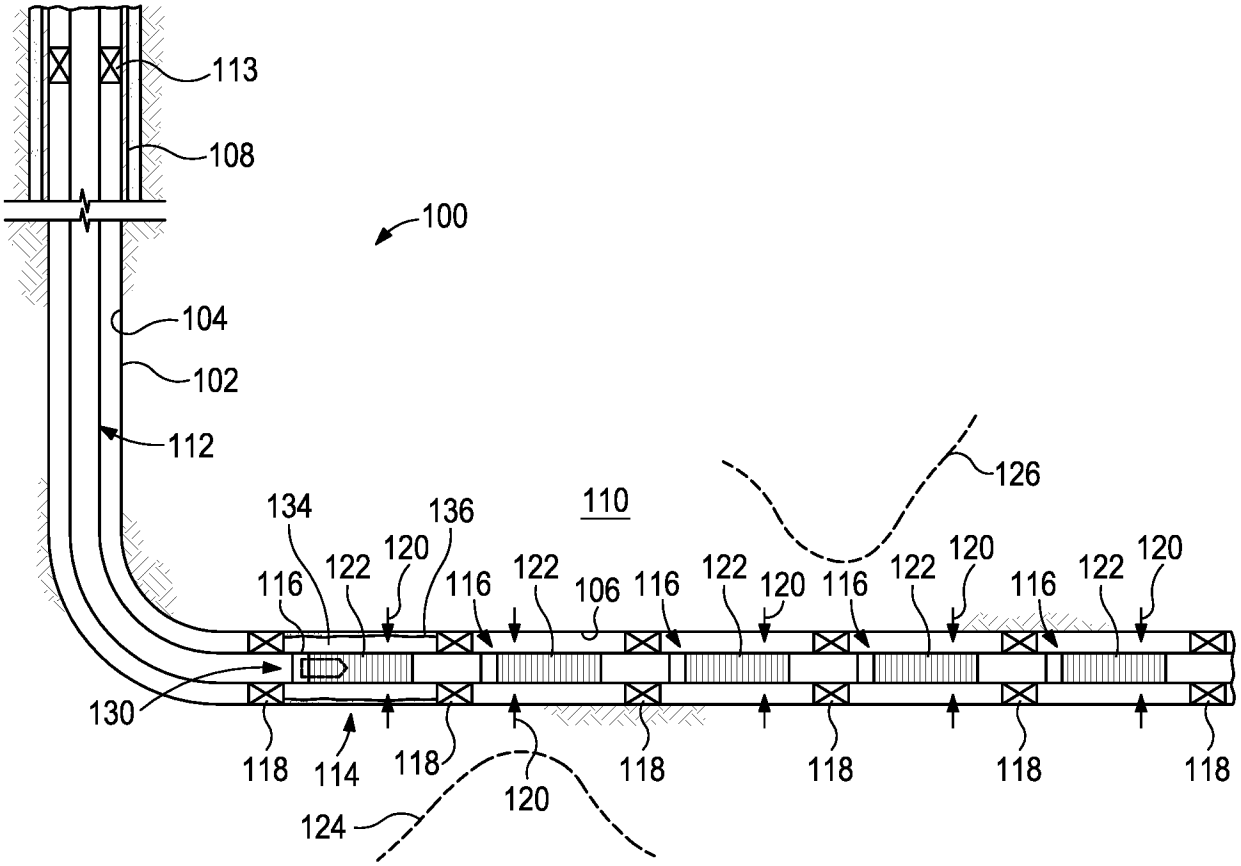
FIG. 1 is a schematic diagram of a well system including a shifting tool for facilitating the removal of filter cake in a substantially horizontal section of a wellbore in accordance with aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to the removal of filter cake from specified intervals subsequent to installing a lower completion assembly in a wellbore. The removal of filter cake subsequent to installing the lower completion assembly may facilitate dislodging a stuck lower completion assembly and may also promote production of targeted fluids through the wellbore.

FIG. 1 is a schematic diagram of an example well system 100 that may employ one or more of the principles of the present disclosure, according to one or more embodiments. As depicted, the well system 100 includes a wellbore 102 that extends through various earth strata and has a substantially vertical section 104 that transitions into a substantially horizontal section 106. A portion of the vertical section 104 may have a string of casing 108 cemented therein, and the horizontal section 106 may extend through a hydrocarbon bearing subterranean formation 110. In some embodiments, the horizontal section 106 may be uncompleted and otherwise characterized as an "open-hole" section of the wellbore 102. In other embodiments, however, the casing 108 may extend into the horizontal section 106, without departing from the scope of the disclosure.

A string of production tubing 112 may be positioned within the wellbore 102 and extend from a well surface location (not shown), such as the Earth's surface. The production tubing 112 provides a conduit for fluids extracted from the formation 110 to travel to the well surface location for production. A hanger 113 is provided between the production tubing and the casing 108. The hanger 113 may be carried by the production tubing 112 and may include radially expandable teeth or other structures that bite into the casing 108 to hold the production tubing 112 in place.

A completion string 114 may be coupled to or otherwise form part of the lower end of the production tubing 112 and arranged within the horizontal section 106. The completion string 114 may be configured to divide the wellbore 102 into various production intervals or "zones" adjacent the subterranean formation 110. To accomplish this, as depicted, the completion string 114 may include a plurality of inflow control devices or "ICDs" 116 axially offset from each other along portions of the production tubing 112. In some embodiments, each inflow control device 116 may be positioned between a pair of wellbore packers 118 that provides a fluid seal between the completion string 114 and the inner wall of the wellbore 102, and thereby defining discrete production intervals or zones.

The inflow control devices 116 are operable to selectively regulate the flow of fluids 120 into the completion string 114 and, therefore, into the production tubing 112. In the illustrated embodiment, each inflow control device 116 includes a sand control screen assembly 122 that filters particulate matter out of the formation fluids 120 originating from the formation 110 such that particulates and other fines are not produced to the well surface location. After passing through the sand control screen assembly 122, the inflow control devices 116 may be operable to regulate the flow of the fluids 120 into the completion string 114. Regulating the flow of fluids 120 into the completion string 114 from each production interval may be advantageous in preventing water coning 124 or gas coning 126 in the subterranean formation 110. Other uses for flow regulation include, but are not limited to, balancing production from multiple production intervals, minimizing production of undesired fluids, maximizing production of desired fluids, etc.

As used herein, the term "fluid" or "fluids" (e.g., the fluids 120) includes liquids, gases, hydrocarbons, multi-phase fluids, mixtures of two of more fluids, water and fluids injected from the surface, such as water. Additionally, references to "water" includes fresh water but should also be construed to also include water-based fluids; e.g., brine or salt water. In accordance with embodiments of the present disclosure, the inflow control devices 116 may have a number of alternative structural features that provide selective operation and controlled fluid flow there through.

It should be noted that even though FIG. 1 depicts the inflow control devices 116 as being arranged in an open-hole portion of the wellbore 102, embodiments are contemplated herein where one or more of the inflow control devices 116 is arranged within cased portions of the wellbore 102. Also, even though FIG. 1 depicts a single inflow control device 116 arranged in each production interval, any number of inflow control devices 116 may be deployed within a particular production interval without departing from the scope of the disclosure. In addition, even though FIG. 1 depicts multiple production intervals separated by the packers 118, any number of production intervals with a corresponding number of packers 118 may be used. In other embodiments, the packers 118 may be entirely omitted from the completion interval, without departing from the scope of the disclosure.

Furthermore, while FIG. 1 depicts the inflow control devices 116 as being arranged in the horizontal section 106 of the wellbore 102, the inflow control devices 116 are equally well suited for use in the vertical section 104 or portions of the wellbore 102 that are deviated, slanted, multilateral, or any combination thereof. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

A shifting tool 130 is provided within the completion string 114 to deploy a filter cake remover 132 (see FIG. 3F) into an annulus 134 defined between the completion string and the wall of wellbore 102. The filter cake remover 132 may remove filter cake 136 from the wall of the wellbore 102 to permit the outflow of targeted fluids from the subterranean formation 110. As illustrated in FIG. 1, a single shifting tool 130 is provided adjacent or including an upper-most sand control screen assembly 122. In other embodiments, a shifting tool 130 may be provided adjacent each of the sand control assemblies 122 without departing from the scope of the disclosure.

Figure 2A:
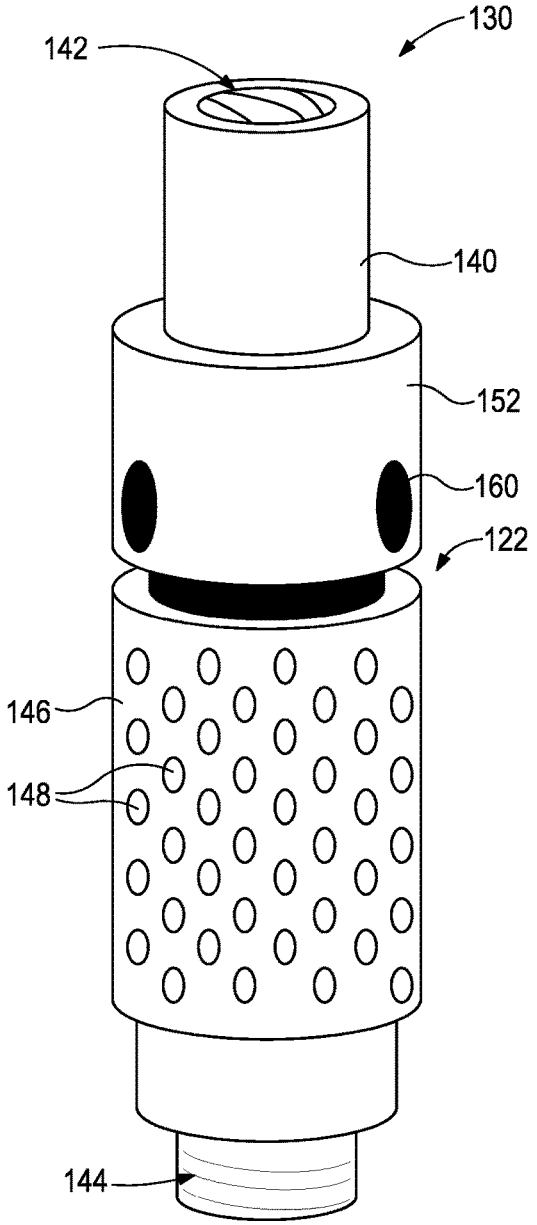
FIGS. 2A and 2B are external and internal schematic views, respectively, of the shifting tool of FIG. 1.
Figure 2B:
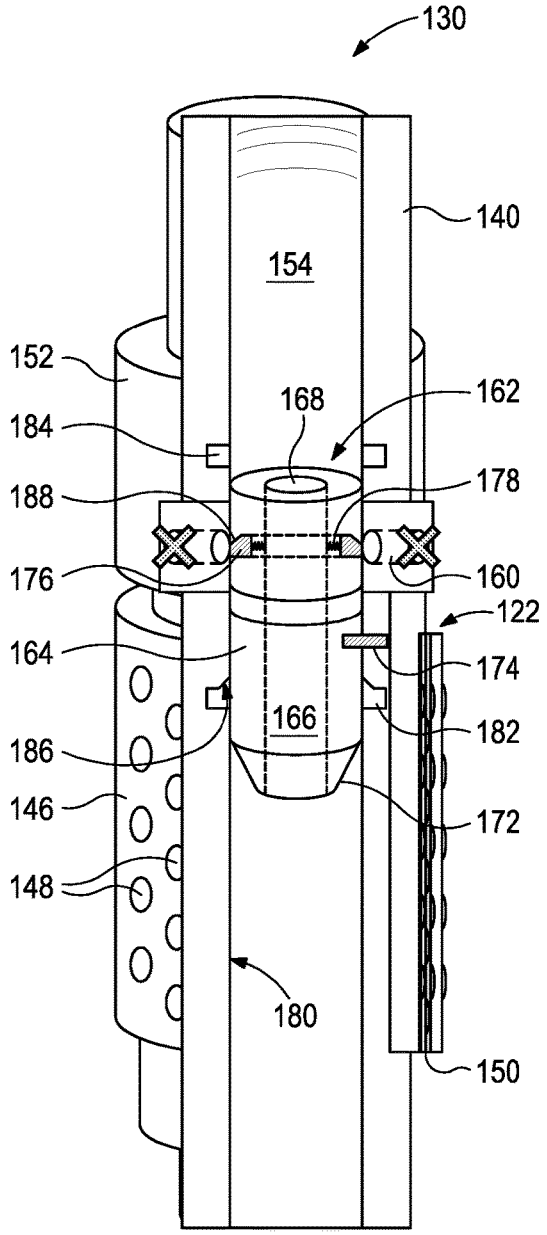

FIG. 2A is an exterior view of the shifting tool 130 and FIG. 2B is a schematic view of an interior of the shifting tool 130 in an initial or run-in configuration, according to one or more embodiments. The shifting tool 130 includes a base pipe 140 having an upper tubing connector 142 and a lower tubing connector 144 for coupling the shifting tool 130 within a completion string 114 (FIG. 1). For example, the upper tubing connector 142 may be a threaded female or "box" connector and the lower tubing connector 144 may be a threaded male or "pin" connector. The sand control screen assembly 122 circumscribes a portion of the base pipe 140. An outer protective shroud 146 of the sand control screen assembly 122 includes an array of openings or perforations 148, which facilitates inflow and outflow of fluid from the screen assembly 122. The protective shroud 146 may be tightly positioned around and against a mesh layer 150 (FIG. 2B) or other filter media wrapped around the base pipe 140. A flow path (not shown) is defined beneath the mesh layer 150 along an exterior of the base pipe 140 to a housing 152 of the sand control screen assembly 122 where fluid may pass through an orifice (not shown) to enter or exit a central flow channel 154 (FIG. 2B) of the base pipe 140.

A plurality of circulation ports 160 extend radially between the central flow channel 154 and the exterior of housing 152. In other embodiments, the circulation ports 160 may be defined through a separate housing (not shown) or directly through a wall of the base pipe 140. In FIG. 2B, the shifting tool 130 is illustrated in an initial closed configuration where flow through the circulation ports 160 is prohibited. A sleeve assembly 162 is disposed within the flow channel 154 and sealingly engages the interior of the base pipe 140 to prohibit flow through the circulation ports 160.

The sleeve assembly 162 includes a shifting sleeve 164 having a longitudinal flow passage 166 defined therethrough. A latching profile 168 may be defined in the shifting sleeve 164 at an upper end of the longitudinal flow passage 166 such that both upward and downward forces may be applied to the sleeve assembly 162 by a running tool 170 (see FIG. 3E), as described below. The shifting sleeve 164 includes a tapered lower end 172 to facilitate downward movement of the sleeve assembly 162 without getting jammed or caught on any uneven surfaces or obstructions in the flow channel 154. A shear pin 174 extends between the shifting sleeve 164 and the base pipe 140, preventing longitudinal movement of the sleeve assembly 162 when the shifting tool 130 is in the initial configuration.

The sleeve assembly 162 also includes a plurality dogs or "latch members" 176 circumferentially spaced around the shifting sleeve 164. The latch members 176 are biased to a radially outward position with respect to the shifting sleeve 164 by respective biasing members 178. The biasing members 178 may include helical compression springs, Belleville washers, wave washers and/or similar structures. The latch members 176 may be circumferentially (angularly) offset from the circulation ports 160 such that the latch members 176 engage an inner diameter 180 of the shifting sleeve 164 and are prevented from extending into the circulation ports 160.

Figure 4C:
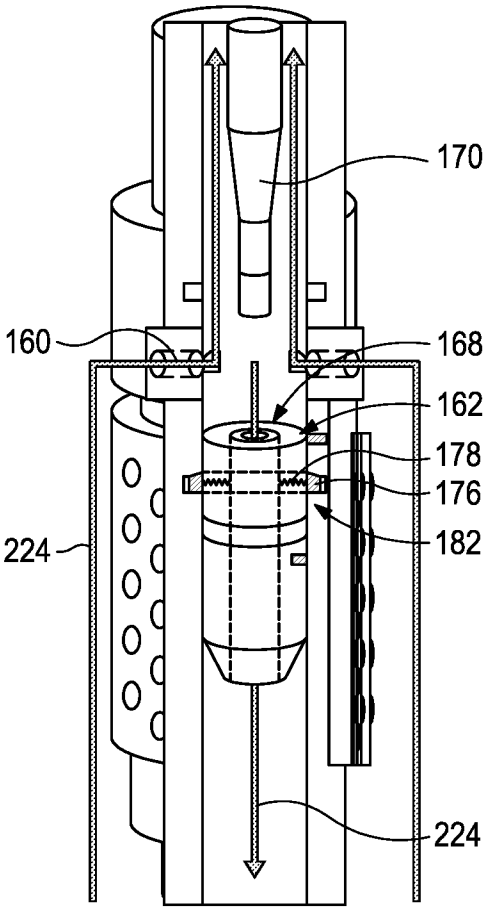
FIGS. 4A through 4C are enlarged views of the shifting tool in various stages of the procedure of FIGS. 3A through 3F wherein circulation ports on the shifting tool are opened.

The inner diameter 180 is profiled to receive the latch members 176 in at least a lower groove 182 and an upper groove 184. In at least one embodiment, the lower and upper grooves 182, 184 may extend a full circumference around the sleeve assembly 162, but in other embodiments, the upper and lower grooves 182, 184 may be segmented to extend only at circumferential positions corresponding to the circumferential positions of the latch members 176. The lower groove 182 is longitudinally positioned along the base pipe 140 such that when the latch members 176 are received therein, the shifting sleeve 164 does not obstruct the circulation ports 160, as shown in FIG. 4C.

In some embodiments, the lower groove 182 may include an upper chamfered surface or taper 186 corresponding to an angled surface 188 of the latch members 174. The angled surfaces 188 of the latch members 176 may engage the upper taper 186 of the lower groove 182 when the latch members 176 are received in the lower groove 182 (see FIG. 4D). The latch members 176 may thus be urged in a radially inward direction against the bias of biasing members 178 when an upward (uphole) force is applied to the shifting sleeve 164. The upper groove 184 is longitudinally positioned such that shifting sleeve 164 obstructs the circulation ports 160 when the latch members 176 are received therein (see FIG. 4E).

Figure 3A:
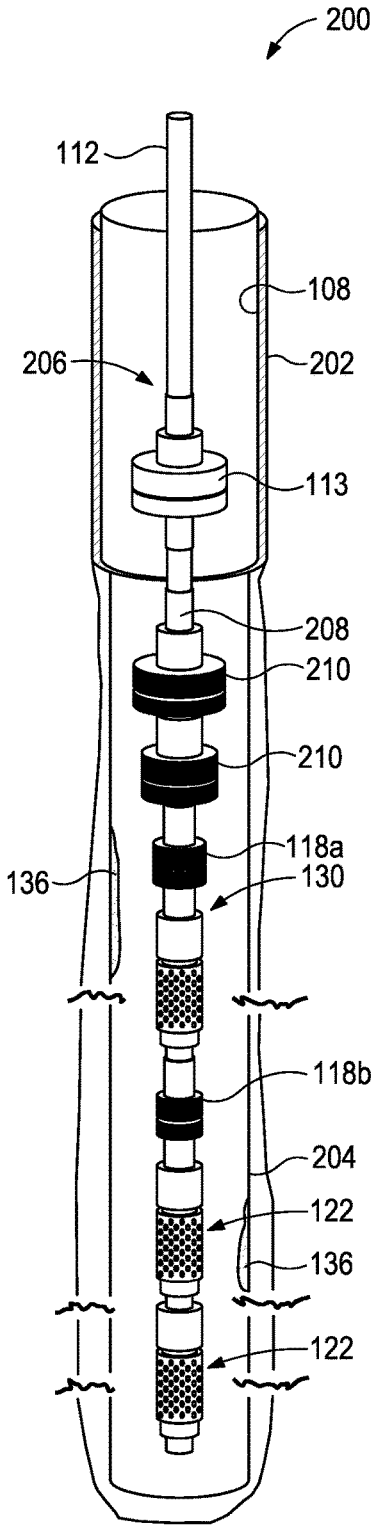
FIGS. 3A through 3G are schematic diagrams of an alternate well system in sequential stages of a procedure in which the shifting tool of FIGS. 2A and 2B is installed and operated in a substantially vertical section of a wellbore in accordance with aspects of the present disclosure.

Referring now to FIGS. 3A through 3G, a procedure is described in which the shifting tool 130 is installed and operated in an example well system 200. As illustrated in FIG. 3A, well system 200 includes a string of casing 108 cemented into a wellbore 202 and an open-hole section 204 of the wellbore 202 extending below the casing 108. A filter cake 136 may remain on any or all of the open-hole section 204 of the wellbore 202. The wellbore 202 is illustrated as a substantially vertical wellbore 202, but the procedure described herein may be practiced equally effectively in wellbore 102 (FIG. 1) or in a wellbore having a different form without departing from the scope of the disclosure.

The well system 200 includes a string of production tubing 112 carrying various components together in a completion string 206. The completion string 206 generally includes a radially extendable hanger 113 at an upper end thereof, a circulation valve 208, a pair of open-hole packers 210, an upper packer 118*a*, a shifting tool 130, a lower packer 118*b* and a pair of lower sand control sleeve assemblies 122. The completion string 206 may be lowered into the wellbore 208 on the production tubing 112 until the open-hole packers 210 enter the open-hole section 204 and the hanger 113 remains within the casing 108.

Figure 3B:
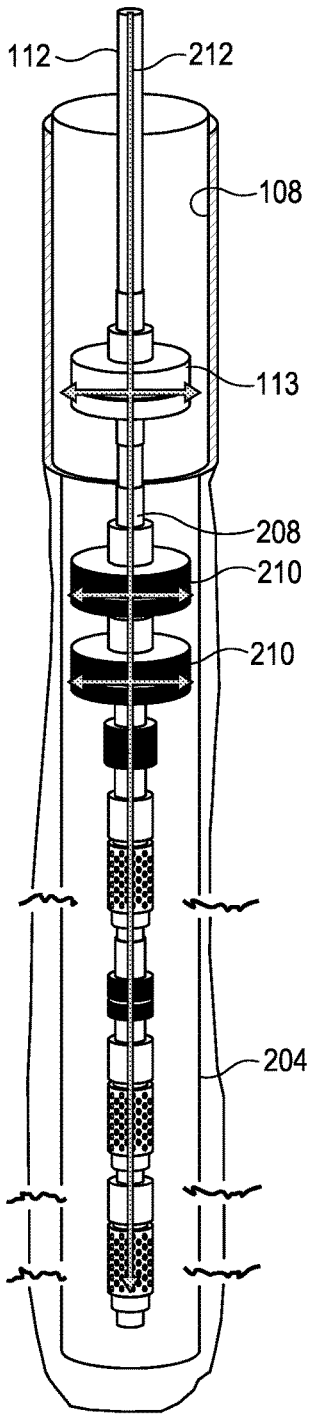

Next, as illustrated in FIG. 3B, the hanger 113 and open-hole packers 210 may be actuated and otherwise radially expanded to engage the casing 108 and the open-hole section 204, respectively. An activation fluid 212 may be pumped from the surface location through the production tubing 112 to expand or extend the hanger 113 and open-hole packers 210. Once the open-hole packers 210 are expanded, continued pumping of the activation fluid 212 to a threshold value may serve to open the circulation valve 208. Once the circulation valve 208 is opened, the pressure may be bled off.

Figure 3C:
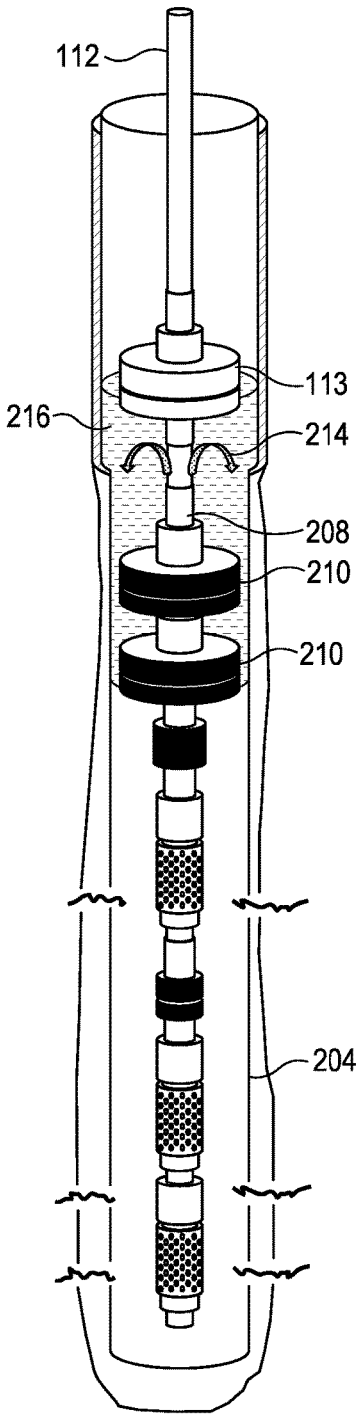

Next, cement 214 may be pumped thorough the production tubing 112 and may be discharged through the circulation valve 208 as illustrated in FIG. 3C. The cement 214 may fill the annular space 216 between the hanger 113 and the open-hole packers 210. The cement 214 may be permitted to cure to isolate and prevent contamination of the open-hole section 204 below the open-hole packers 210.

Figure 3D:
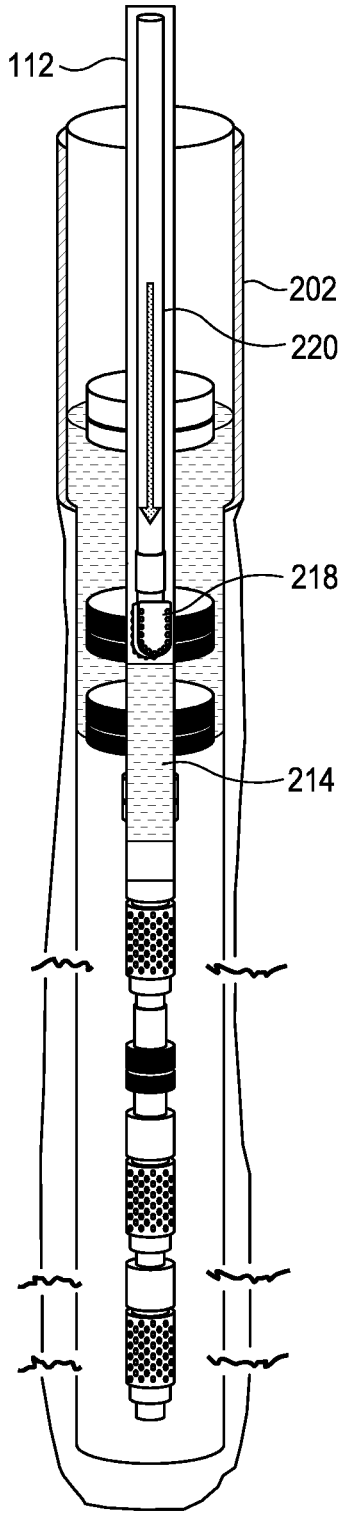

As illustrated in FIG. 3D, excess cement 214 may be removed from the production tubing 112 with a milling tool 218. The milling tool 218 may be lowered to the cement 214 and rotated by a drill string 220 extending to the surface location through the production tubing 112. Once the excess cement 214 is removed, the milling tool 218 may be withdrawn from the wellbore 202.

Figure 3E:
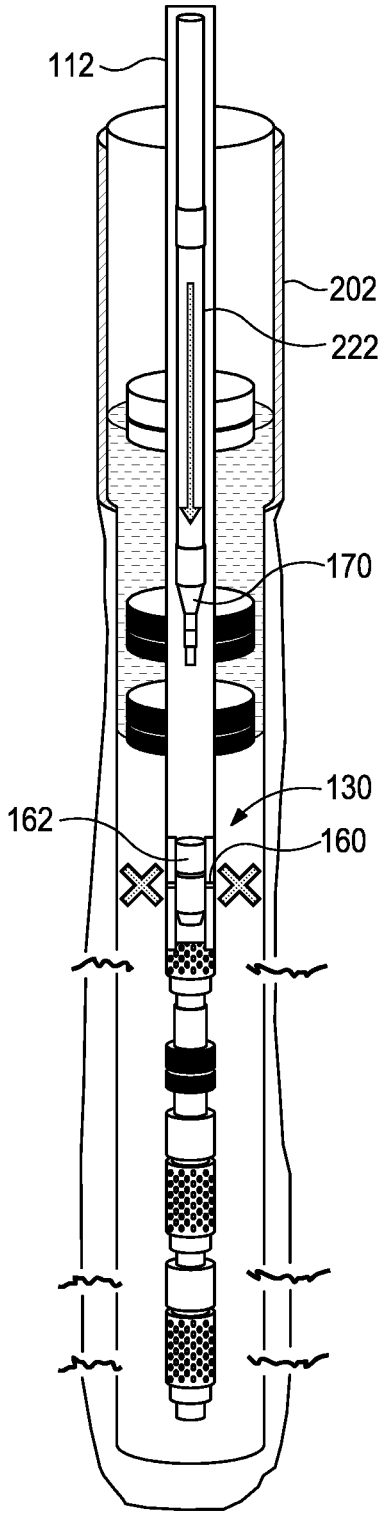

Running tool 170 may then be run into the wellbore 202 toward the shifting tool 130 as illustrated in FIG. 3E. The shifting tool 130 is arranged in the initial configuration (see FIG. 2B) wherein the circulation ports 160 are closed by the sleeve assembly 162. The running tool 170 may be delivered on a conveyance 222 operable to deliver fluid downhole. For example, conveyance 222 may include a coiled tubing strand, segmented pipes or similar structures.

Figure 3F:
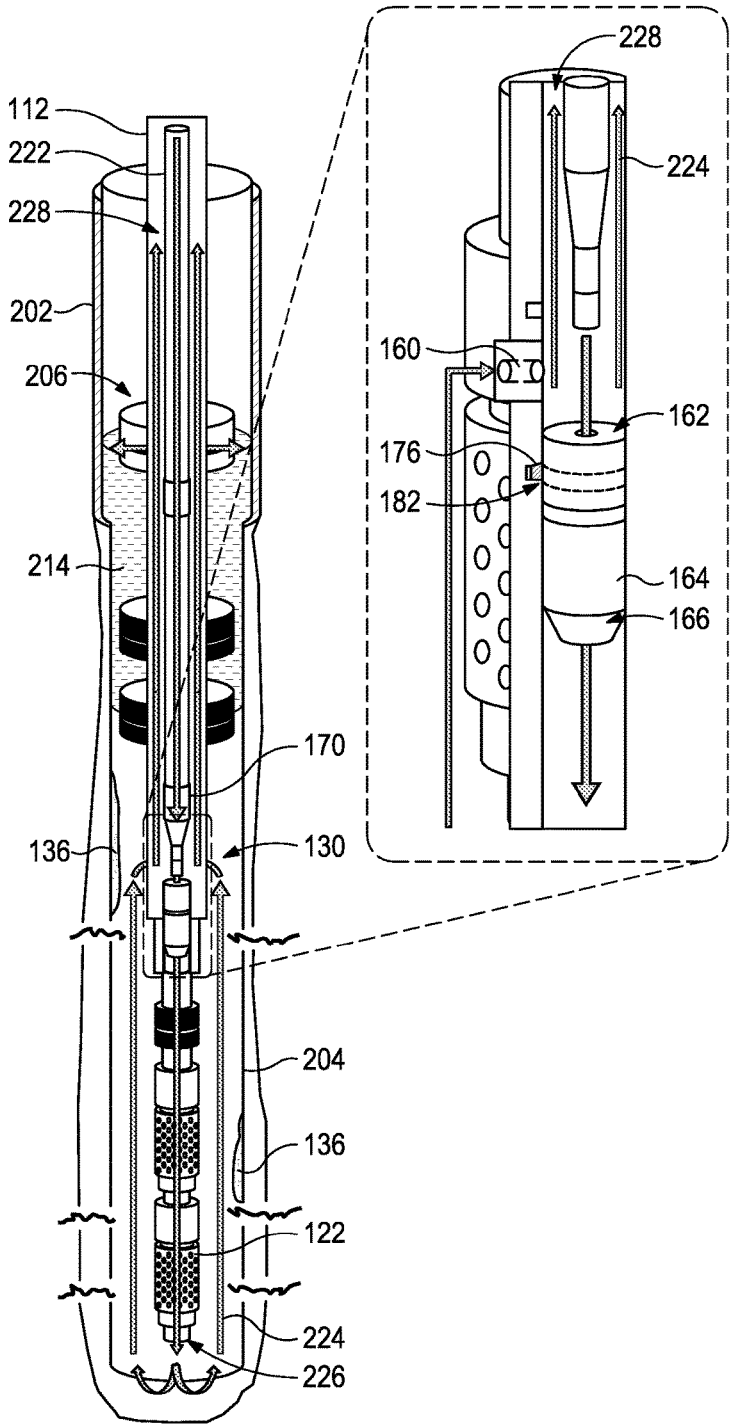

As illustrated in FIG. 3F, once the running tool 170 arrives at the shifting tool 130, the running tool 170 may locate and engage (mate with) the sleeve assembly 162 to open (expose) the circulation ports 160 and circulate a spotting fluid 224 through the open-hole section 204. As described in greater detail below with reference to FIGS. 4A through 4C, the running tool 170 may apply a downward force on the sleeve assembly 162. With reference to the inset graphic in FIG. 3F, the downward force may be applied until the latch members 176 engage the lower groove 182 and the circulation ports 160 are unobstructed.

The spotting fluid 224 may include any fluid composition that may be useful in subterranean applications for addressing, for example, drill string sticking difficulties. Oil-based muds may traditionally be used as spotting fluids, but surfactants and other cleaning solutions are contemplated for use as spotting fluid 224. The spotting fluid 224 may be delivered through the conveyance 222 to the shifting sleeve 164. The spotting fluid 224 continues through the longitudinal flow passage 166 of the shifting sleeve 164 and through the remainder of the completion string 206 where it may be discharged through a lowermost one of the sand control sleeve assemblies 122 and/or an opening 226 defined at the lower end of the completion string 206. The spotting fluid 224 may fill the open-hole section 204 below the cement 214 and pass through the circulation ports 160 to enter the production tubing 112. The spotting fluid 224 may then flow upward to the surface location through an annulus 228 defined between the conveyance 222 and the production tubing 112. The spotting fluid 224 may interact with the filter cake 136 and remove the filter cake 136 from the open-hole section 204 of the wellbore 202. The spotting fluid 224 may dislodge, dissolve or otherwise remove the filter cake 136 from the wall of wellbore 202.

Figure 3G:
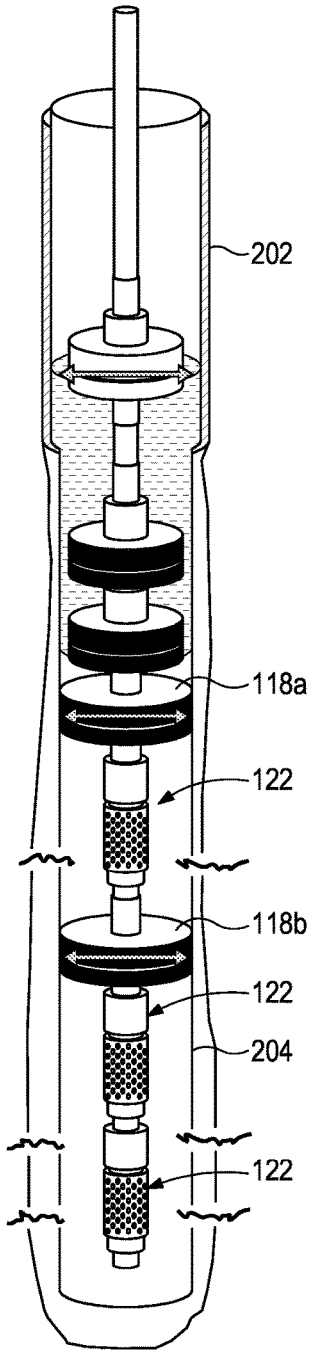

As illustrated in FIG. 3G, the running tool 170 (FIG. 3F) may be withdrawn from the wellbore 202 and the packers 118*a,b* around the screen assemblies 122 may be set. The open hole section 204 may be free of filter cake 136 (FIG. 3F) such that the packers 118*a,b* may effectively engage the open-hole section 204 and targeted fluids may enter the open hole section 204 of the wellbore for production to the surface location through the screen assemblies 122.

Figure 4B:
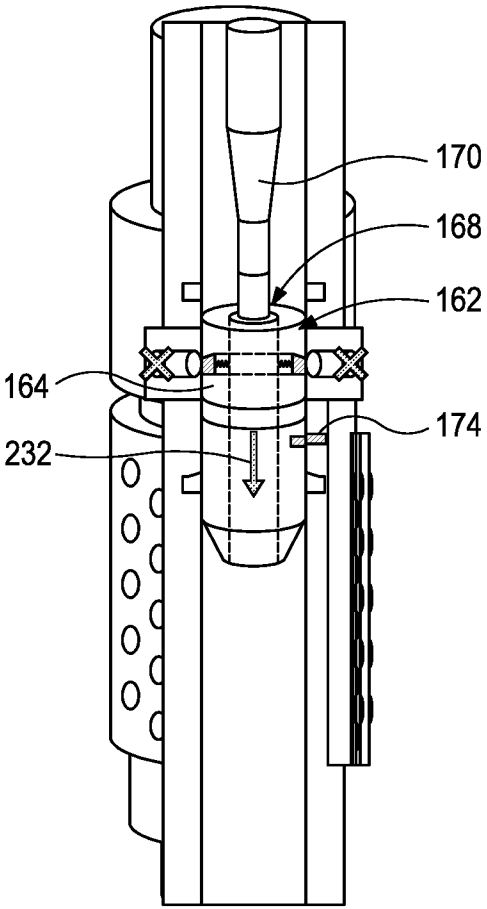
Figure 4A:
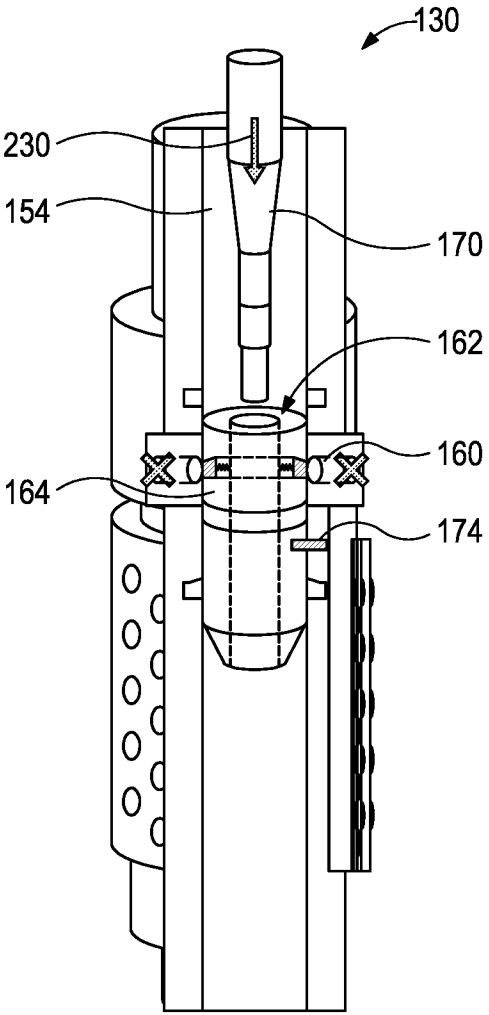

Referring now to FIGS. 4A through 4E, operation of the shifting tool 130 is described in greater detail. As illustrated in FIG. 4A, the shear pin 174 maintains the sleeve assembly 162 in a longitudinal (axial) position where the circulation ports 160 are obstructed by the shifting sleeve 164. The running tool 170 is conveyed downward through the central flow channel 154 in the direction of arrow 230 toward the sleeve assembly 162. As illustrated in FIG. 4B, the running tool 170 engages the latching profile 168 of the shifting sleeve 164 and applies a downward force sufficient to shear the shear pin 174. The sleeve assembly 162 is then free to translate downward in the direction of arrow 232 until the sleeve assembly 162 reaches the longitudinal position illustrated in FIG. 4C. The latching members are 176 are extended radially into the lower groove 182 under the bias of the biasing members 178, thereby securing the sleeve assembly 162 in a longitudinal position where the circulation ports 160 are open. The running tool 170 may be disengaged from the latching profile 168 and the spotting fluid 224 may be circulated through the circulation ports 160.

Figure 4E:
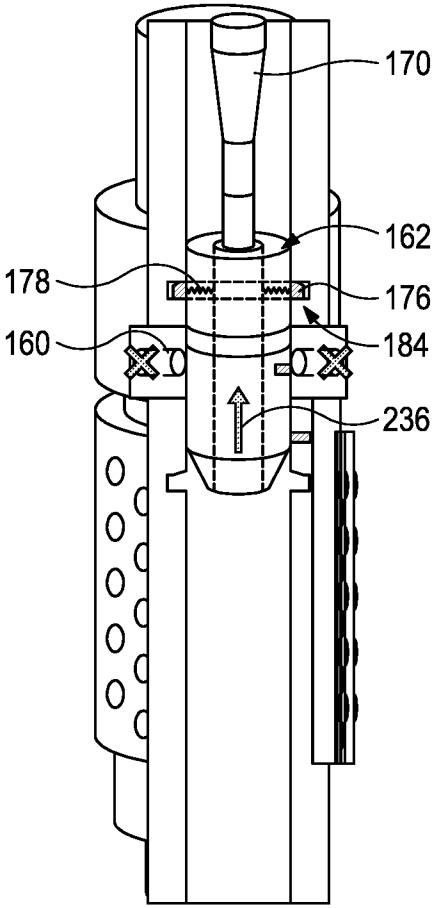
FIGS. 4D and 4E are enlarged views of the shifting tool being moved to a configuration wherein the circulation ports are closed such as when the well system is arranged in the configuration of FIG. 3G.
Figure 4D:
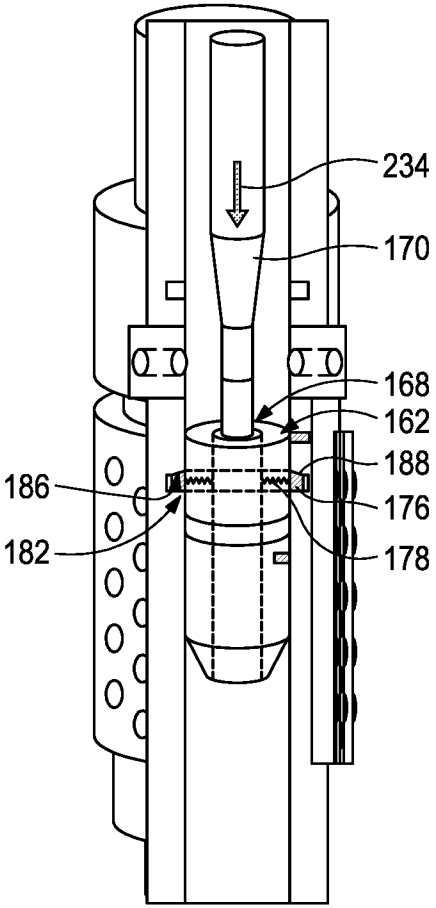

Next, as illustrated in FIG. 4D, the running tool 170 may again be moved downward in the direction of arrow 234 to engage the latching profile 168. An upward force may then be applied to the sleeve assembly 162 with the running tool 170. The upward force causes the angled surfaces 188 of the latch members 176 to engage the upper taper 186 of the lower groove 182. The latch members 176 are urged radially inwardly against the bias of biasing members 178 to permit the sleeve assembly 162 to translate upward. As illustrated in FIG. 4E, the sleeve assembly 162 translates upward in the direction of arrow 236 until the latch members 176 reach the upper groove 184. The biasing members 178 extend the latch members 176 into the upper groove 184 securing the sleeve assembly 162 in a longitudinal positon where the circulation ports 160 are closed. The running tool 170 may then be withdrawn and production of targeted fluids may be commenced through the screen assemblies 122.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method for removing filter cake from a subterranean wellbore, the method comprising:

running a completion string into the wellbore on production tubing, the completion string including one or more screen assemblies coupled therein;

conveying a running tool through the production tubing to a shifting tool arranged within the completion string;

opening a circulation port of the shifting tool with the running tool;

flowing a spotting fluid through the running tool and the shifting tool and discharging the spotting fluid from the completion string into an annulus defined between the completion string and the wellbore;

interacting the spotting fluid with the filter cake to remove the filter cake from a wall of the wellbore; and circulating the spotting fluid from the annulus and into the production tubing through the circulation port.

2. The method of claim 1, further comprising closing the circulation port subsequent to circulating the spotting fluid, and then producing a targeted fluid through the one or more screen assemblies.

3. The method of claim 2, wherein opening and closing the circulation port includes:

engaging a shifting sleeve of the shifting tool with the running tool; and moving the shifting sleeve longitudinally within a base pipe of the shifting tool with the running tool.

4. The method of claim 3, further comprising latching the shifting sleeve to the base pipe in a longitudinal position wherein flow through the circulation port is permitted and a longitudinal position wherein flow through the circulation port is obstructed by the shifting sleeve.

5. The method of claim 3, wherein opening the circulation port includes applying a force to the shifting sleeve to shear a shear pin securing the shifting sleeve to the base pipe.

6. The method of claim 1, further comprising expanding a hanger of the completion string to secure the completion string in the wellbore.

7. The method of claim 6, further comprising expanding an open-hole packer of the completion string below the hanger.

8. The method of claim 7, further comprising filling an annular space between the hanger and the open-hole packer with cement prior to opening the circulation port.

9. The method of claim 1, further comprising isolating the one or more screen assemblies in discrete production intervals in the wellbore by expanding one or more wellbore packers subsequent to circulating the spotting fluid.

10. A system for removing filter cake from a subterranean wellbore, the system comprising:

a string of production tubing extending into the wellbore, a completion string defined at a lower end of the production tubing, the completion string including one or more screen assemblies coupled therein;

a shifting tool coupled within the completion string, the shifting tool including a circulation port extending between a central flow channel and an exterior of the shifting tool and a sleeve assembly selectively movable within the central flow channel between a first longitudinal position wherein the circulation port is obstructed and a second longitudinal position wherein the circulation port is closed; and a running tool at a lower end of a conveyance extending through the string of production tubing, the running tool selectively operable to move the sleeve assembly between the first and second longitudinal positions and to deliver a spotting fluid from the conveyance through the shifting tool.

11. The system of claim 10, wherein the sleeve assembly includes a latching member radially extendable into a groove defined in the central flow channel to secure the sleeve assembly in the second longitudinal position.

12. The system of claim 11, further comprising a shear pin extending between the sleeve assembly and a base pipe of the shifting tool to secure the sleeve assembly in the first longitudinal position.

13. The system of claim 10, further comprising a hanger coupled within the completion string, the hanger radially extendable to secure the completion string in the wellbore.

14. The system of claim 13, further comprising an open-hole packer coupled within the completion string and cement filling an annular space defined between the hanger and the open-hole packer.

15. The system of claim 10, further comprising one or more wellbore packers coupled within the completion string, the one or more wellbore packers expandable to isolate the one or more screen assemblies in discrete production intervals in the wellbore.

* * * * *